US008210461B1

(12) United States Patent
Strope

(10) Patent No.: US 8,210,461 B1
(45) Date of Patent: Jul. 3, 2012

(54) DEVICE FOR SECURING STRAP

(76) Inventor: Greg L. Strope, Tulsa, OK (US)

( * ) Notice: Subject to any disclaimer, the term of this patent is extended or adjusted under 35 U.S.C. 154(b) by 295 days.

(21) Appl. No.: 12/703,373

(22) Filed: Feb. 10, 2010

(51) Int. Cl.
*B65H 75/28* (2006.01)
*B65H 75/30* (2006.01)
*B65H 75/38* (2006.01)

(52) U.S. Cl. ..... 242/395; 242/402; 242/405.2

(58) Field of Classification Search .... 242/388.1–388.5, 242/395, 395.1, 399, 401, 402, 405, 405.1, 242/405.2, 405.3, 407, 407.1, 579, 580, 580.1, 242/588, 588.2; 254/217, 218
See application file for complete search history.

(56) References Cited

U.S. PATENT DOCUMENTS 5,458,241 A 10/1995 Brown
6,318,612 B1 11/2001 MacNeil
6,425,543 B1 * 7/2002 King ..... 242/405.2
6,789,671 B2 9/2004 Morrison et al.
6,848,937 B1 2/2005 Hsiao
7,165,294 B2 1/2007 Surdam
7,464,916 B1 12/2008 Drinkhorn

FOREIGN PATENT DOCUMENTS

GB 2200381 A * 8/1988

* cited by examiner

*Primary Examiner* — William E Dondero
(74) *Attorney, Agent, or Firm* — Molly D. McKay

(57) ABSTRACT

A device for securing excess tie down strap on a base formed by two approximately parallel spaced apart arms held together centrally with at least one crosspin. Spring loaded clevis pins provided at a distal end of each arm serve to open channels formed between the arms so that strap can be wound onto or off of the base by gripping the clevis pins as handles and rotating the device. Each clevis pin is movable retained in one of the arms and is rotatable therein by means of a flanged sleeve bearing located within a bushing provided in an opening in the arm. When the clevis pin is in its closed position, an inwardly extending free end of the clevis pin inserts through an aligned opening in the opposite arm and is retained therein by an outwardly biased detent provided on the free end.

6 Claims, 3 Drawing Sheets

DEVICE FOR SECURING STRAP

BACKGROUND OF THE INVENTION

1. Field of the Invention

The present invention is a device for securing excess strap and is designed for use in securing excess strap from a tie down device, such as those used by truckers to tie down their cargo.

2. Description of the Related Art

Truckers use tie down devices to secure their cargo on their trucks.

However, the straps for the tie down devices are normally quite long and when the tie downs are in use, storage of the excess length of the straps can be problematic and a safety hazard. The present invention is designed to reduce clutter, reduce need for storage space, reduce wear, and reduce time by providing a convenient device for securing excess strap. In the shipping business, one of the most popular items is the 2 inch wide nylon ratchet strap. It is used by many companies for the safe transportation of goods. The strap is placed over the specific load, one hook is then placed on one side of the vehicle and the opposite hook is placed on the opposite side. Then the ratchet is tightened to tighten the strap until the load is securely held to the trailer. The common problem is that the straps come from the factory in lengths of 27 to 33 feet. Most loads only require the use of about 8 to 12 feet of the strap, leaving approximately 20 fee of unused strap to be dealt with. Because at times more of the strap may be needed, no one wants to cut off or waste the excess length of strap. Also, when not in use, the complete length of the strap must be stored. Rolling up the length of strap by hand or alternately not rolling it up will both create clutter in storage. The present invention eliminates the loose excess strap in transport, eliminates clutter in storage and frees up storage space in addition to other benefits. The present invention will safely secure excess strap in transit, with reduce storage clutter, will allow strap to be hung on back guard for convenience, will save time in securing loads, and will reduce wear on strap due to wind flail damage that would otherwise occur to the unsecured excess strap.

The present invention is an H-shaped base that is specifically designed to secure excess strap. The H-shaped base has two handles on opposing ends that pop snap out, then the excess strap is wound around the base by simply rotating the handles. Once the strap is wrapped onto the base to the desired length, the handles simply snap back into the base to prevent the strap from unwinding off of the base. Alternately, to release the strap from the base, the handles are once again pop snapped out, the handles rotated in the opposite direction, and the strap unwinds from the base.

SUMMARY OF THE INVENTION

The present invention is an H-shaped base that is specifically designed to secure excess strap by opening to allow the strap to wound around the base and by closing to prevent the strap from being unwound therefrom until the base is once again opened to allow the strap to be unwound. The base is formed from two arms that are held in approximately parallel, spaced apart orientation by one or more crosspins that are located approximately centrally on the arms and extend between the two arms. The crosspins will serve as the core around which the excess strap is to be wound when the base is opened for that purpose. The arms define a channel on either side of the crosspins where the excess strap can be stored once it is wound around the crosspins. At the distal end of each channel, a spring-loaded quick release clevis pin is provided. One clevis pin is provided in one of the arms and the other clevis pin is provided in the other arm so that when the clevis pins are opened, the spring outward beyond the arms on either end of the base.

The clevis pins serve two functions. First, when the clevis pins are secured between the two arms, they function to close the channels and prevent strap that has been wound onto the crosspins from unwinding off of the base. Second, when the clevis pins are released, they are spring loaded to extend outward from each side of the base and serve as handles by which the base can be rotated either to wind strap onto the base, or alternately, to unwind strap off of the base. Each clevis pin is movable retained in one of the arms and is rotatable therein by means of a flanged sleeve bearing located within a bushing provided in an opening in the arm. When the clevis pin is in its closed position, an inwardly extending free end of the clevis pin inserts through an aligned opening in the opposite arm as a means of preventing the strap from being unwound from the base. The free end of the each clevis pin is provided with an outwardly biased detent that moves inward to allow the end of the clevis pin to pass through the aligned opening in the opposite arm.

In use, the two handles on opposing ends of the base are pop snapped outwardly from the base and then the excess strap is wound around the base by simply rotating the handles. Once the strap is wrapped onto the base to the desired length, the handles simply snap back into the base to prevent the strap from unwinding off of the base. Alternately, to release the strap from the base, the handles are once again pop snapped out, the handles rotated in the opposite direction, and the strap unwinds from the base.

DETAILED DESCRIPTION OF THE PREFERRED EMBODIMENT

Figure 1:
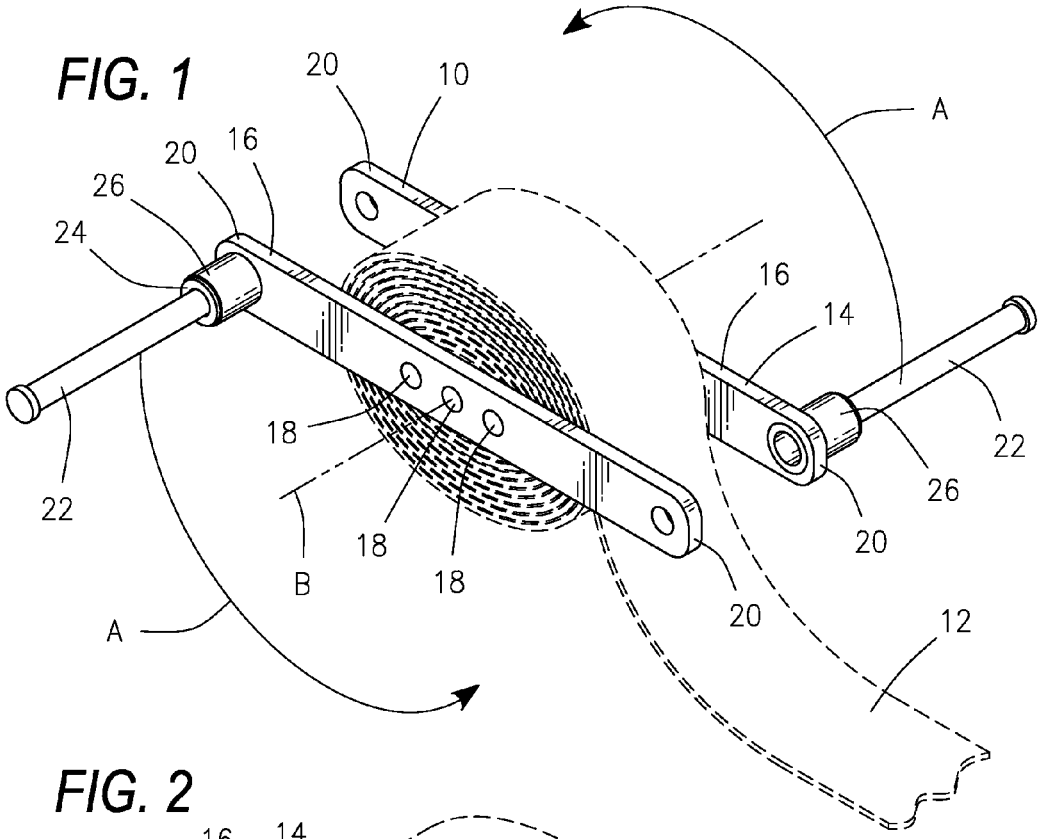
FIG. 1 is a perspective view of a device for securing strap shown in use in its open position and being rotated to wind strap onto the base of the device.
Figure 2:
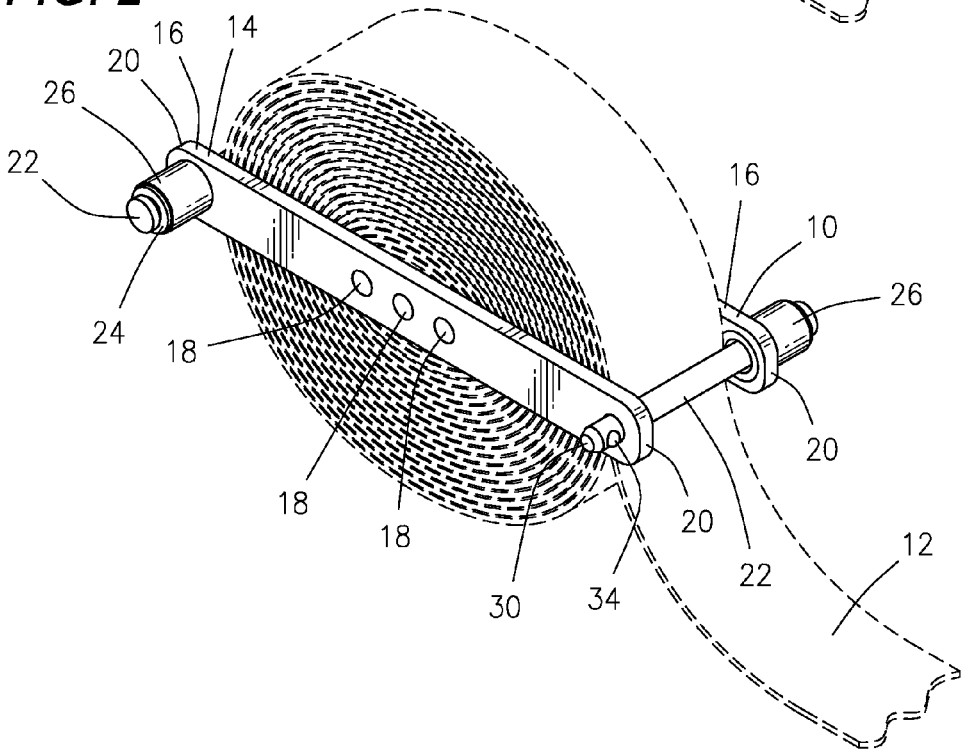
FIG. 2 is a perspective view of the device of FIG. 1 shown in use in its closed position with the strap wound around the H-shaped base of the device and prevented from unwinding by the locked clevis pins at each end of the device.

Referring now to the drawings and initially to FIGS. 1 and 2, there is illustrated a device for securing strap 10 that is constructed in accordance with a preferred embodiment of the present invention. The device 10 is an H-shaped base 14 that is specifically designed to secure excess strap 12 by opening to allow the strap 12 to be wound around the base 14 and by closing to prevent the strap 12 from being unwound therefrom until the base 14 is once again opened to allow the strap 12 to be unwound.

Referring also to FIGS. 3-6, the base 12 of the device 10 is formed from two arms 16 that are held in approximately parallel, spaced apart orientation by one or more crosspins 18 that are located approximately centrally on the arms 16 and extend between the two arms 16. The crosspins 18 will serve as the core around which the excess strap 12 is to be wound when the base 12 is opened for that purpose. The two arms 16 define channels 17 on either side of the crosspins 18 where the excess strap 12 can be stored once it is wound around the crosspins 18. At a distal end 20 of each channel one of the arms 16 is provided with a spring-loaded quick release clevis pin 22 movable secured thereto. One clevis pin 22 is provided in one of the arms 16 and the other clevis pin 22 is provided in the other arm 16 so that when the clevis pins 22 are opened, they spring outward beyond the arms 16 on either side of the base 16.

The clevis pins 22 serve two functions. First, when the clevis pins 22 are secured between the two arms 16, they function to close the channels 17 and prevent the strap 12 that has previously been wound onto the crosspins 18 from unwinding off of the base 14. Second, when the clevis pins 22 are released, they are spring loaded to extend outward from oppose sides of the base 14 and serve as handles by which the base 14 can be rotated either to wind strap 12 onto the base 14, or alternately, to unwind strap 12 from the base 14.

Figure 7:
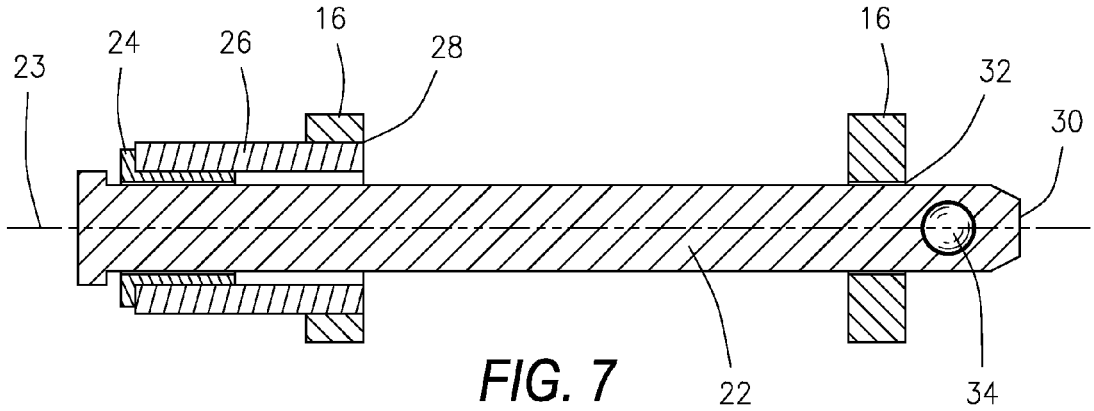
FIG. 7 is a cut away view of the device taken along line 7-7 of FIG. 5 showing the internal structure.

Referring also to FIG. 7, each clevis pin 22 is movable retained in one of the arms 16 so that the clevis pin 22 can move relative to the arm 16 along a longitudinally axis 23 of the clevis pin 22 and is rotatable relative to the arm 16 by means of a flanged sleeve bearing 24 located within a bushing 26 provided in a bushing opening 28 provided in the arm 16.

When the clevis pin 22 is in its closed position, as illustrated in FIGS. 2, 4, and 5-7, an inwardly extending free end 30 of the clevis pin 22 inserts through an aligned opening 32 in the opposite arm 16 as a means of preventing the strap 12 from being unwound from the base 14. The free end 30 of each clevis pin 22 is provided with an outwardly biased detent 34 that moves inward to allow the free end 30 of the clevis pin 22 to pass through the aligned opening 32 in the opposite arm 16 to thereby either secure or release the free end 30 from the opposite arm 16 and thereby either close or open the base 14.

Figure 3:
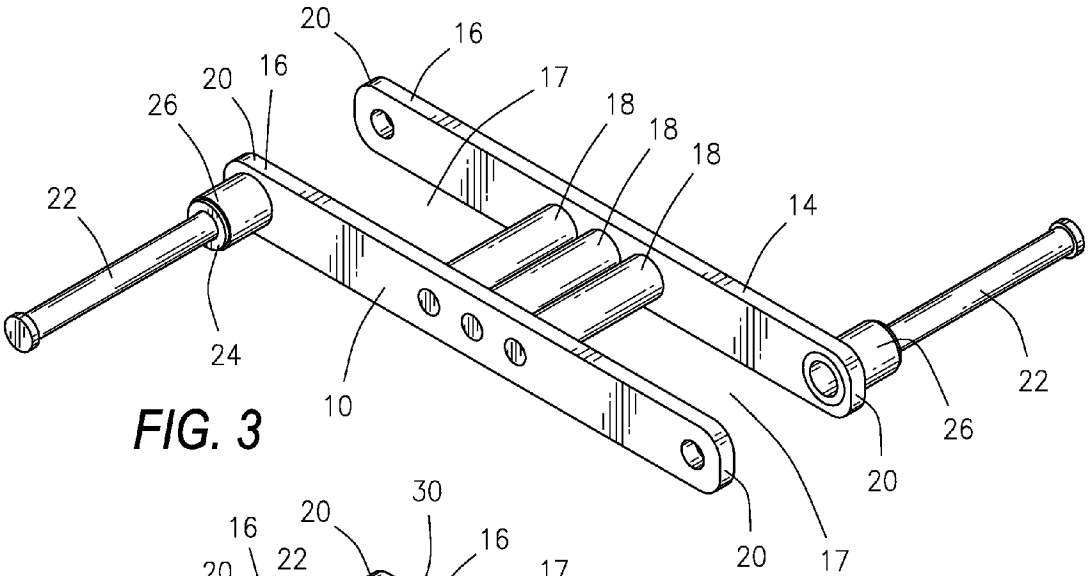
FIG. 3 is a perspective view of the device of FIG. 1 shown in its open position.
Figure 4:
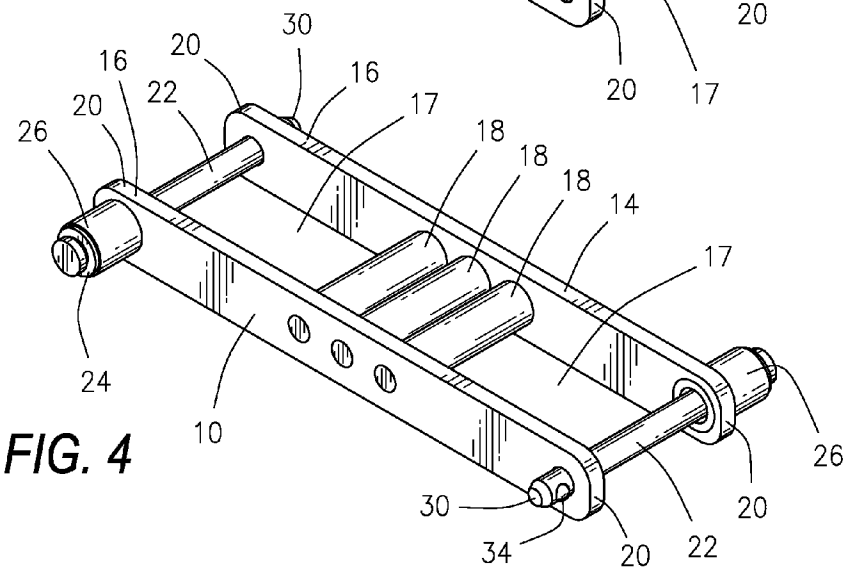
FIG. 4 is a perspective view of the device of FIG. 2 shown in its closed position.
Figure 5:
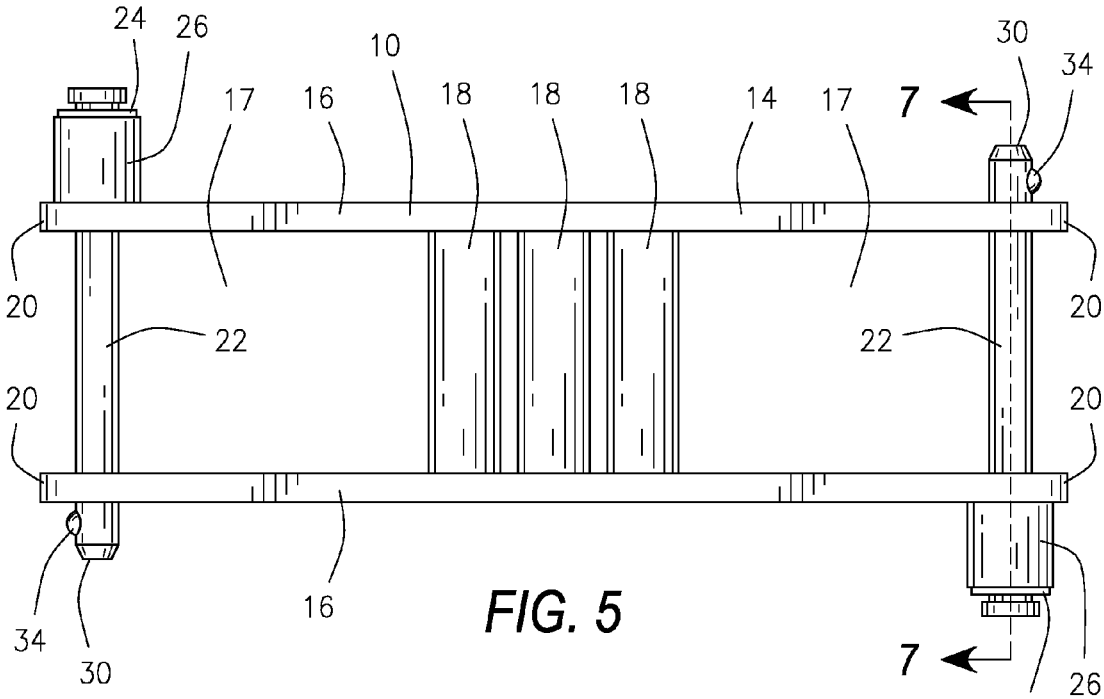
FIG. 5 is top plan view of the device of FIG. 4.
Figure 6:
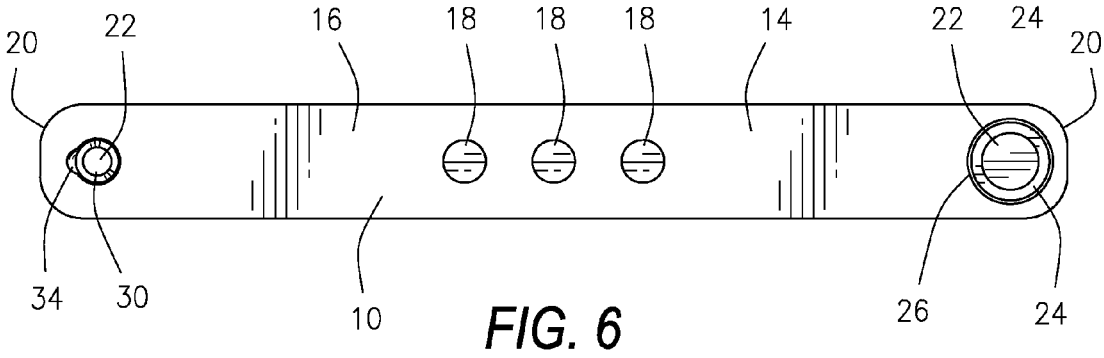
FIG. 6 is a side view of the device of FIG. 5.

In use, the two clevis pins 22 which serve as handles that are located on opposing ends of the base 14 are pop snapped outwardly from the base 14, as shown in FIGS. 1 and 3 and then the excess strap 12 is wound around the base 14 by simply rotating the handles as shown by the arrows A in FIG. 1 around axis B. Once the strap 12 is wrapped onto the base 14 to the desired length, the clevis pins 22 which serve as the handles simply snap back into the base 14 to prevent the strap 12 from unwinding off of the base 14, as illustrated in FIG. 2. Alternately, to release the strap 12 from the base 14, the clevis pins 22 which serve as the handles are once again pop snapped out and rotated in the opposition direction, thereby unwinding the strap 12 from the base 14.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A device for securing excess strap comprising:

a base formed by two approximately parallel spaced apart arms held together centrally with at least one crosspin so as to form channels between the arms on either side of the at least one crosspin where strap can be wound, closure means provided at the ends of the spaced apart arms on each side of the base which serve to open the channels formed between the arms so that strap can be wound onto or off of the base and which serve to close the channels formed between the arms so that strap cannot be unwound off of the base, and said closure means movably retained in the arms and rotatable relative thereto so that the closure means serve as handles for rotating the base to wind or unwind the strap from the base.

2. A device according to claim 1 wherein the base is H-shaped.

3. A device according to claim 1 wherein said closure means further comprise:

outwardly spring loaded clevis pins, an inwardly extending free end of each clevis pin insertable through an aligned opening in the opposite arm to close the channels formed between the arms, and said free end of each clevis pin provided with an outwardly biased detent for retaining the free end in the aligned opening.

4. A device according to claim 3 wherein the base is H-shaped.

5. A device according to claim 3 further comprising:

a flanged sleeve bearing located within a bushing provided in an opening in a distal end of each arm for movably and rotatably retaining the clevis pins.

6. A device according to claim 5 wherein the base is H-shaped.

* * * * *